US007325629B2

(12) United States Patent
Blaschke et al.

(10) Patent No.: US 7,325,629 B2
(45) Date of Patent: Feb. 5, 2008

(54) METHOD AND SYSTEM FOR PROCESSING OIL AND GAS WELL CUTTINGS UTILIZING EXISTING SLURRY PROCESSING EQUIPMENT

(75) Inventors: Keith Edward Blaschke, Duncan, OK (US); Kevin Michael Stewart, Duncan, OK (US); Bryan Clint Walker, Duncan, OK (US); Timothy Neal Harvey, Humble, OK (US); Danny Keith Mints, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 271 days.

(21) Appl. No.: 11/222,272

(22) Filed: Sep. 8, 2005

(65) Prior Publication Data

US 2007/0051539 A1 Mar. 8, 2007

(51) Int. Cl.
*E21B 21/06* (2006.01)

(52) U.S. Cl. ..... 175/66; 175/205

(58) Field of Classification Search ..... 175/66, 175/206, 207

See application file for complete search history.

(56) References Cited

U.S. PATENT DOCUMENTS

| | | | |
|---|---|---|---|
| 4,649,655 A | 3/1987 | Witten | |
| 5,109,933 A | 5/1992 | Jackson | |
| 5,129,469 A | 7/1992 | Jackson | |
| 5,303,786 A | 4/1994 | Prestridge et al. | |
| 6,102,310 A | 8/2000 | Davenport | |
| 6,553,901 B2 * | 4/2003 | Reddoch | 100/45 |

FOREIGN PATENT DOCUMENTS

| | | |
|---|---|---|
| CA | 2067215 | 2/1992 |
| DE | 69118158 T | 9/1996 |
| EP | 0200418 | 12/1986 |
| EP | 0276546 | 8/1988 |
| EP | 0496850 B1 | 3/1996 |
| GB | 2 327 442 | 1/1999 |
| NO | 921485 | 4/1992 |
| NO | 0311148 B1 | 10/2001 |
| WO | WO92/03633 | 3/1992 |

OTHER PUBLICATIONS

Foreign communication related to a counterpart application dated Nov. 13, 2006.

Gidatec for DCRI, CRI or Cuttings Reinjection; http://www.gidatec.co.uk/Cuttings.htm; Jul. 14, 2005; 3 pgs.

* cited by examiner

*Primary Examiner*—William P Neuder

(74) *Attorney, Agent, or Firm*—John W. Wustenberg; Conley Rose, L.L.P.

(57) ABSTRACT

A method for integrating a batch cement process with a cuttings reinjection process, the method comprising: equipping a batch cement skid with a particle classifier and a grinding pump, such that the batch cement skid sequentially implements the cuttings reinjection process and the batch cement process is disclosed. An apparatus for performing a batch cement process and a cuttings reinjection process, the apparatus comprising: a first tank and a second tank, a particle classifier having a coarse effluent stream feeding into the first tank and a fine effluent stream feeding into the second tank, and a grinding pump in fluid communication with the first tank and the particle classifier is also disclosed.

20 Claims, 8 Drawing Sheets

CONTINUED ON SHEET 2/8

METHOD AND SYSTEM FOR PROCESSING OIL AND GAS WELL CUTTINGS UTILIZING EXISTING SLURRY PROCESSING EQUIPMENT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Drilling is the process by which a well bore is created to extract a fluid from the earth. Generally, a well bore is drilled into the earth using a drill string comprising a drill bit attached to the lower end of a rotating drill pipe. A drilling fluid is circulated down the center of the drill string and up through the annulus between the drill pipe and the walls of the well bore. The drilling fluid picks up the drilled cuttings (cuttings), which are pieces of dirt and rock that are broken off of the bottom of the well bore by the drill bit, and carries the cuttings to the surface. Once at the surface, the cuttings are separated from the drilling fluid so that the drilling fluid can be recirculated through the drill string. The separated cuttings are prepared and/or transported for disposal.

Disposal of cuttings is particularly challenging when drilling offshore. The cuttings are frequently coated with oil, thus it is not preferable to dump the cuttings into the water for environmental reasons. However, loading the cuttings onto a ship for disposal on land is expensive and also entails an additional degree of risk. Therefore, offshore drilling platforms frequently employ a cuttings reinjection (CRI) process to dispose of the cuttings. Key to the CRI process is size reduction of cuttings implemented by one or more grinding pumps located on a CRI skid. The grinding pump (s) grind and classify the cuttings into small particles cuttings with seawater or other suitable fluid to create a cuttings slurry. This cuttings slurry is then injected into a subsurface formation adjacent to the well bore via a dedicated disposal well, or through the annulus of the well being drilled. Unfortunately, the addition of the CRI skid to the offshore drilling platform utilizes a significant amount of valuable space on a drilling platform. In addition, the CRI skid requires additional personnel and other resources to operate the CRI skid. It would be preferable if the CRI process could be integrated with another process, thereby decreasing the overall personnel and resources required to operate the offshore drilling platform. Consequently, a need exists for a method for integrating a CRI process with another process on an offshore drilling platform in order to minimize the consumption of space, personnel, and other resources.

SUMMARY

In one aspect, a method for integrating a batch cementing process with a cuttings reinjection process, the method comprising: equipping a batch cementing skid with a particle classifier and grinding pump(s), such that the batch cementing skid sequentially implements the cuttings reinjection process and the batch cementing process. In an embodiment, the cuttings reinjection process comprises: mixing a plurality of coarse cuttings with water or other suitable fluid in a tank, thereby creating a cuttings slurry, grinding at least some of the coarse cuttings in the cuttings slurry, thereby creating a plurality of fine cuttings, and injecting the fine cuttings into a well bore. In another embodiment, the cuttings reinjection process further comprises: separating the coarse cuttings from the cuttings slurry, such that the cuttings slurry comprises cuttings appropriately sized solids and water or other suitable fluid. The method may further comprise: adding the fine drill cuttings to the cement slurry prior to injecting the cement slurry into the well bore. In embodiments, the batch cement process comprises: emptying the cuttings slurry from the tank prior to preparing the cement slurry for cementing operations. Variously, the particle classifier is positioned above the batch cement skid, and the grinding pump is located on a sub-skid positioned below the batch cement skid.

In another aspect, an apparatus for performing a batch cement process and a cuttings reinjection process, the apparatus comprising: a first tank and a second tank, a particle classifier having a coarse effluent stream feeding into the first tank and a fine effluent stream feeding into the second tank, and a grinding pump in fluid communication with the first tank and the particle classifier. In an embodiment, the apparatus further comprises: a densitometer in fluid communication with the first tank, the second tank, or the first tank and the second tank. In another embodiment, the coarse effluent stream is gravity fed into the first tank and the fine effluent stream is gravity fed into the second tank. The grinding pump may be configured to grind a plurality of cuttings and pump the ground cuttings to the first tank, the particle classifier, or the first tank and the particle classifier. The grinding pump may be positioned on a tray that slides out from beneath the first tank or the second tank, thereby allowing a user to service the grinding pump(s). The particle classifier may comprise a tray comprising a plurality of apertures of the predetermined size (e.g. a screening device), wherein the coarse effluent stream comprises the coarse cuttings and the fine effluent stream comprises a plurality of fine cuttings having a size equal to or smaller than the predetermined size. The invention includes a drilling platform comprising the apparatus.

In yet another aspect, a method comprising: mixing a plurality of coarse cuttings with water or other suitable fluid in a tank, thereby creating a cuttings slurry, grinding at least some of the coarse cuttings in the cuttings slurry, thereby creating a plurality of fine cuttings, injecting the fine cuttings into a well bore, emptying the cuttings slurry from the tank, preparing a cement slurry in the tank, and injecting the cement slurry into the well bore. In an embodiment, the method further comprises: separating the coarse cuttings from the cuttings slurry, such that the cuttings slurry comprises fine cuttings and water or other suitable fluid. The method may further comprise: adding the fine cuttings to the cement slurry such that the fine cuttings and the cement slurry are injected into the well bore together. In another embodiment, the method further comprises: measuring a density of the cuttings slurry, comparing the density of the cuttings slurry to a density specification, responsive to the determination that the density of the cuttings slurry is less than the density specification, adding additional fine cuttings or a dry additive to the cuttings slurry, and responsive to the determination that the density of the cuttings slurry is greater than the density specification, adding additional water or other suitable fluid to the cuttings slurry. The invention may further include a drilling platform for placement of the equipment and implementation of the method.

BRIEF DESCRIPTION OF THE DRAWINGS

For a more complete understanding of the present invention, and for further details and advantages thereof, reference is now made to the accompanying drawings, in which.

DETAILED DESCRIPTION

The advantageous features described herein are achieved by the Integrated Cement and Cuttings Reinjection System (ICCRS), which integrates the CRI process with another process, such a batch cement process, conducted at a drilling location. The ICCRS comprises a batch cement portion to perform the batch cement process and a CRI portion to perform the CRI process. Traditionally, the batch cement process has performed by a batch cement skid, which comprised at least one tank and a circulation pump mounted on a portable. structural steel skid. Similarly, the CRI process has traditionally been performed by a CRI skid, which comprised a grinding pump and at least one tank mounted on a portable structural steel skid. When both the batch cement skid and the CRI skid are utilized, they each require their own controls, personnel, and other resources. However, the integration of the two skid-mounted processes into a single skid-mounted package, the ICCRS, decreases the space consumed by the skid, the amount of personnel required to implement the two processes on the skid, the controls required to operate the skid, and the resources consumed by the skid. The reduction in space, personnel, and resource consumption is particularly advantageous on offshore drilling platforms, but the ICCRS may be implemented at any drilling location. In an embodiment, the ICCRS is created by retrofitting or otherwise equipping an existing batch cement skid with grinding pump(s) and a separator or particle classifier, thereby providing the skid with the processing equipment required to implement either the CRI process or the batch cement process. Of course, persons of ordinary skill in the art will appreciate that the integration can also be achieved by manufacturing a new skid that contains the same processing equipment as the retrofitted skid.

Figure 1:
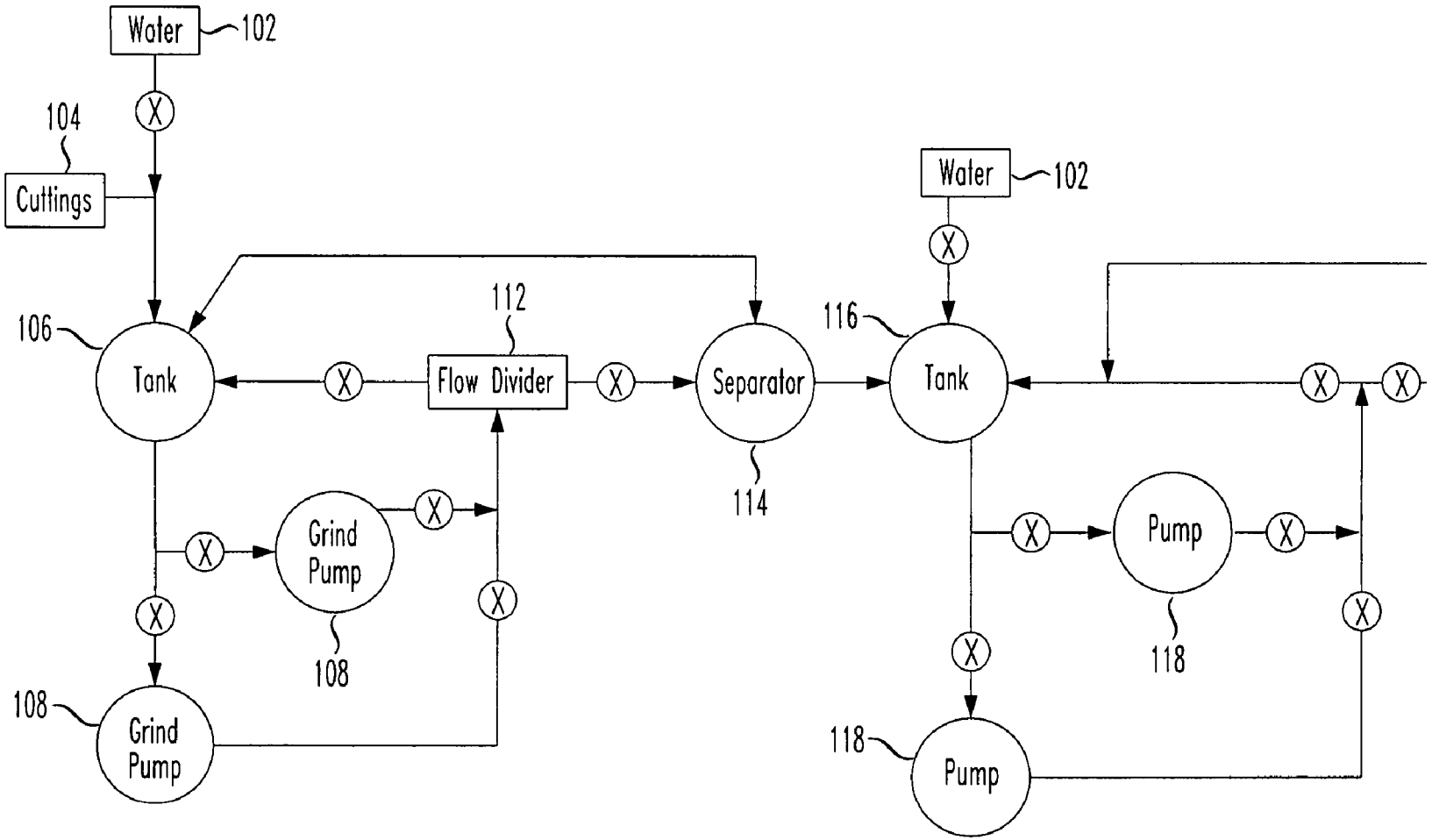
FIG. 1 is process flow diagram of one embodiment of the Integrated Cement and Cuttings Reinjection System (ICCRS)
Figure 1:
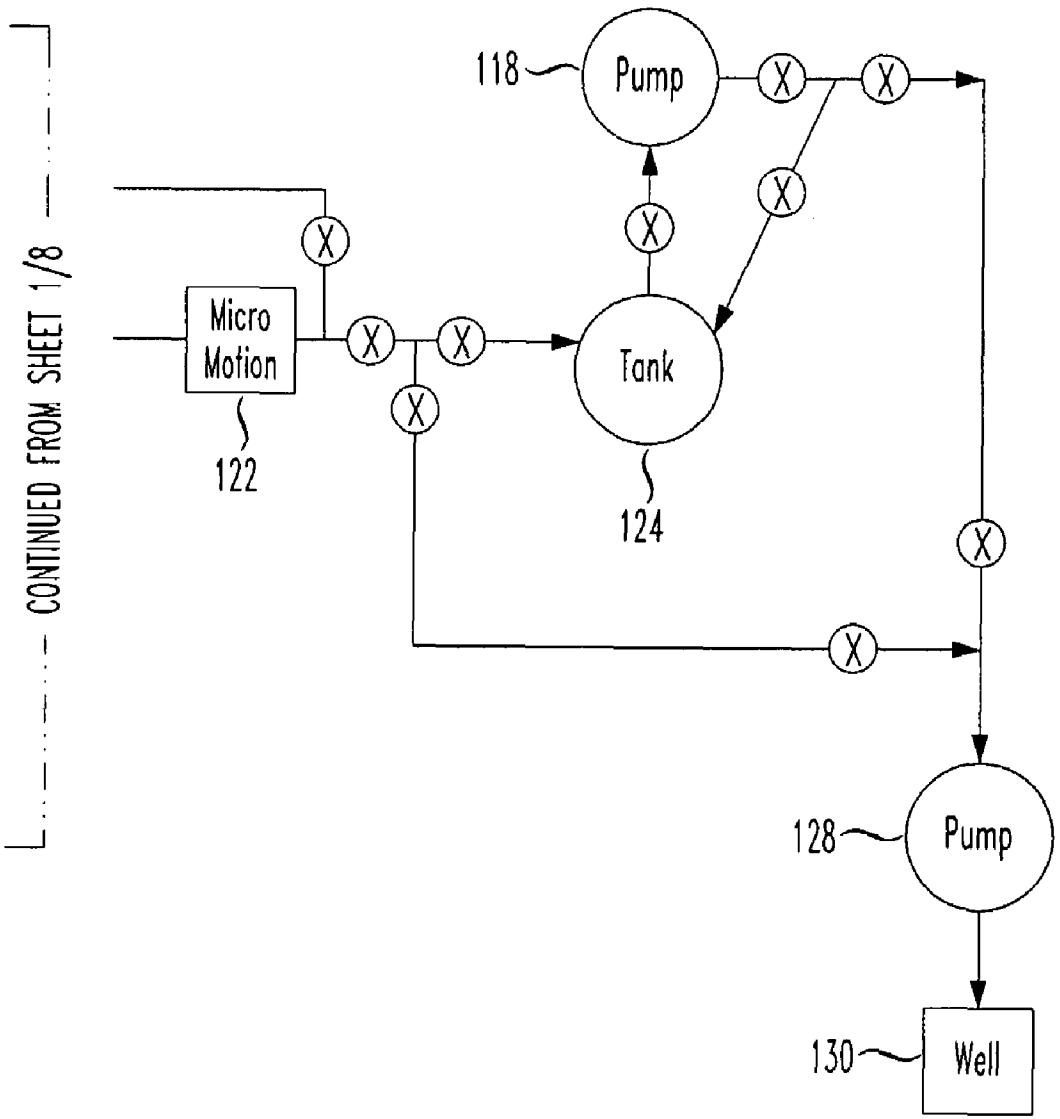

FIG. 1 is a process flow diagram of one embodiment of the ICCRS 100 that is implemented on the retrofitted batch cement skid. The components and process equipment involved in the ICCRS 100 are water or other suitable fluid 102, cuttings 104, tanks 106, 116, and 124, grinding pumps 108, particle classifier 114, transfer pumps 118, injection pump 128, and a well 130, each of which is explained in further detail below. The cuttings 104 are produced by the drill string in a well, which may be the same or different than well 130. The cuttings are typically separated from the drilling fluid using a shale shaker. The cuttings 104 are then mixed with water or other suitable fluid 102 to form a cuttings slurry, which is deposited into the tank 106. Alternatively, the cuttings 104 and water or other suitable fluid 102 may be mixed in tank 106 to form the cuttings slurry therein. The cuttings slurry then passes through one or both of the grinding pumps 108. The grinding pumps 108 are configured such that one of the grinding pumps 108 is able to sufficiently grind the cuttings 104 in the cuttings slurry even if the other grinding pump 108 is removed from service, for example, for maintenance. When the cuttings slurry exits the grinding pump 108, the cuttings slurry is transported to the flow divider 112. The flow divider 112 sends some or all of the cuttings slurry to the particle classifier 114 and, if desired, returns some of the cuttings slurry back to the tank 106 for mixing back into the cuttings slurry. Alternatively, the flow divider 112 may be replaced with a second grinding pump, whereby a first grinding pump transfers slurry to the particle classifier and a second grinding pump recirculates the slurry back to the tank 106. The particle classifier 114 separates the coarse cuttings from the cuttings slurry and produces a coarse effluent stream comprising the coarse cuttings and a fine effluent stream comprising the remainder of the cuttings slurry, namely the fine cuttings and the water or other suitable fluid. The particle classifier 114 returns the coarse effluent stream to tank 106 and transports the fine effluent stream to tank 116. If desired, the coarse cuttings can be transported to an optional grinder or mill before being returned to the tank 106. In the tank 116, other additives may be added to the cuttings slurry using an additive metering system. Transfer pumps 118 can be used to transfer the cuttings slurry into or out of the tank 116 as needed and also circulate the cuttings slurry within the tank 116. Similar to the configuration of the grinding pumps 108, the transfer pumps 118 are configured to allow one of transfer pumps 118 to transfer the cuttings slurry to another location, such as to the injection pump 128, or circulate the cuttings slurry within the tank 116 while the other transfer pump 118 may be taken offline, for example, for maintenance. If desired, some or all of the cuttings slurry in tank 116 can be circulated through the densitometer 122 to measure the density of the cuttings slurry. Also if desired, additional water or other suitable fluid 102 can be added to the tank 116 to bring the density of the cuttings slurry in the tank 116 to within a cuttings slurry specification. When the cuttings slurry meets the cuttings slurry specification, the cuttings slurry may then be transported directly to the injection pump 128 for injection into the well 130, or may be transported to the tank 124 for storage prior to being injected into the well 130. The tank 124 is also configured with a transfer pump 118 to circulate the cuttings slurry within the tank 124 and transfer the cuttings slurry to the injection pump 128. In an embodiment, the tank 124, transfer pump 118, and injection pump 128 are not located on the same skid as the particle classifier 114, grinding pumps 108, and the tanks 106 and 116, but instead may be located on one or more separate skids or otherwise positioned at the worksite.

Figure 2:
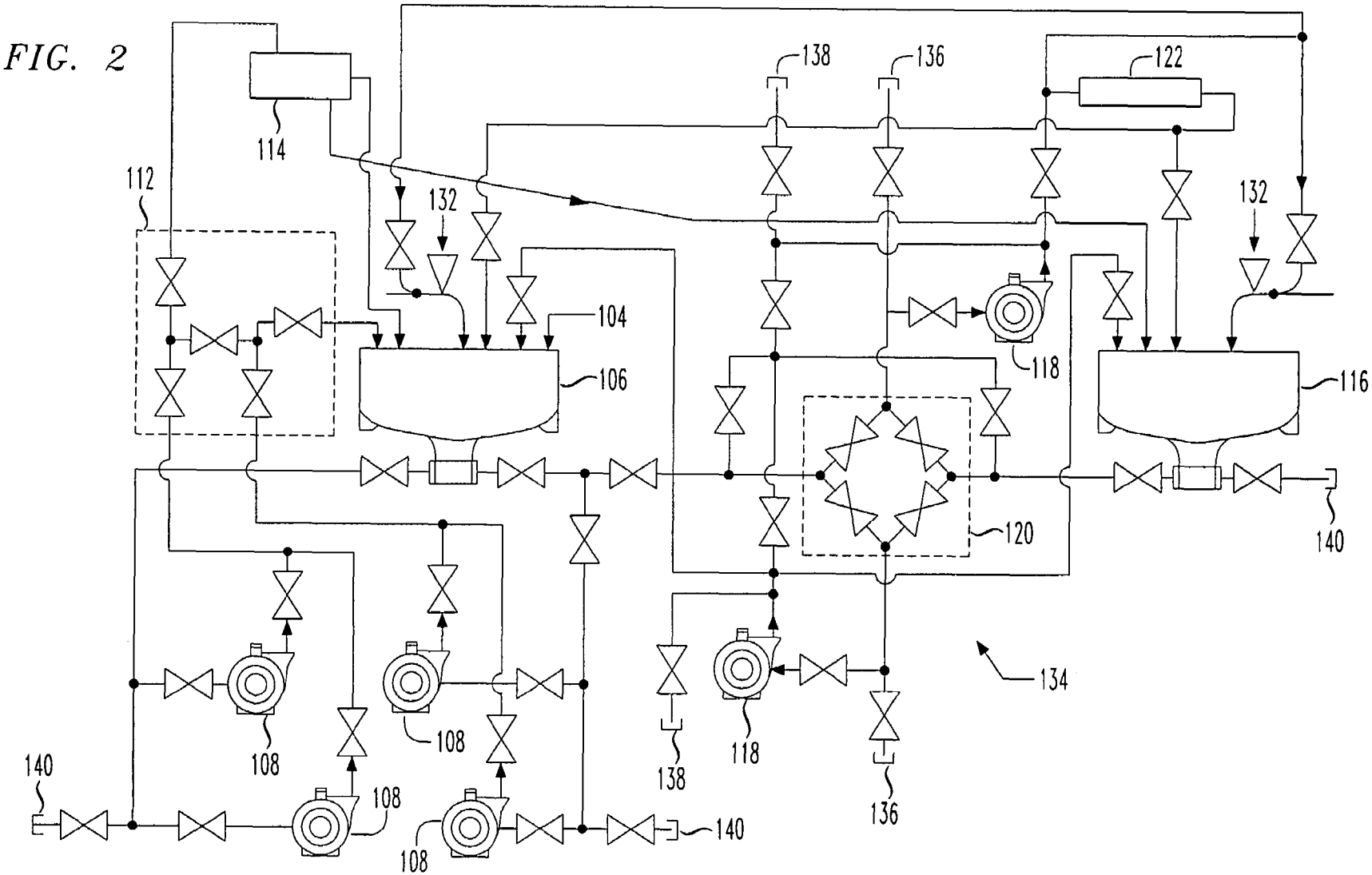
FIG. 2 is a piping diagram of one embodiment of the ICCRS.

FIG. 2 is a piping diagram of a skid 134 configured to implement a CRI portion of the ICCRS 100. Similar to the process flow diagram illustrated in FIG. 1, the skid 134 shown in FIG. 2 is equipped with all of the process equipment necessary to implement the CRI portion of the ICCRS 100, namely tanks 106 and 116, grinding pumps 108, particle classifier 114, and transfer pumps 118. The cuttings 104 are deposited into the tank 106 and the water or other suitable fluid enters the skid through one of the inlets 136. The cuttings 104 are mixed with the water or other suitable fluid in the tank 106, thereby forming the cuttings slurry. Four grinding pumps 108 are provided, however only two grinding pumps 108 are used at any given time: one of the grinding pumps 108 circulates the cuttings slurry within the tank 106 while the other grinding pump 108 grinds the cuttings in the cuttings slurry and transports the cuttings slurry to the particle classifier 114. The other two grinding pumps 108 serve as backups should one of the first two grinding pumps 108 fail or otherwise need to be taken offline, for example, for maintenance. Accordingly, the piping between the tank 106, the grinding pumps 108, and the particle classifier 114 is configured such that two of the grinding pumps 108 can be removed from service, for example, for maintenance, without disrupting the ICCRS 100.

When the cuttings arrive at the particle classifier 114, the particle classifier 114 removes the coarse cuttings from the cuttings slurry and produces a coarse effluent stream comprising the coarse cuttings and a fine effluent stream comprising the remainder of the cuttings slurry, namely the fine cuttings and the water or other suitable fluid. The particle classifier 114 returns the coarse effluent stream to tank 106 and transports the fine effluent stream to tank 116. The densitometer 122 can be used to monitor the density, flow rate, and other properties of the cuttings slurry within either of the tanks 106 or 116. The piping of the skid 134 is configured with a crossover manifold 120 that allows either of the transfer pumps 118 to circulate the cuttings slurry within either of the tanks 106 or 116. Such a redundancy in the design of the skid 134 allows the ICCRS 100 to continue if one of the transfer pumps 118 has to be removed from service, for example, for maintenance. In addition, the crossover manifold 120 allows the cuttings slurry to be transferred between the two tanks 106 and 116, if desired. The cuttings slurry then exits the skid 134 through one of the discharges 138. Several drains 140 are also provided so that the tanks 106 and 116 and the piping may be emptied, for example, when the skid 134 needs be serviced or cleaned, or for preparing to implement the batch cement process described below. The cuttings slurry may then be transported directly to the injection pump for injection into the well, or may be transported to a storage tank for storage prior to being injected into the well. The storage tank is also configured with a transfer pump to circulate the cuttings slurry within the storage tank and transfer the cuttings slurry to the injection pump. In an embodiment, the tank, transfer pump, and injection pump are not located on the same skid as the particle classifier 114, grinding pumps 108, and the tanks 106 and 116, but instead may be located on one or more separate skids or otherwise positioned at the worksite.

With reference again to FIG. 2, in addition to the CRI portion of the ICCRS 100, the skid 134 implements a batch cement portion of the ICCRS 100 by first preparing cement slurry in one of the tanks 106 or 116 and then injecting the cement slurry into the well bore. First, the tanks 106 and 116 and the remainder of the skid 134 are emptied of the cuttings slurry. If desired, the tanks 106 and 116 and the piping of the skid 134 can be flushed with water or other suitable fluid or other wise cleaned. An unrefined cement slurry is then pumped into the tank 106 via one of the inlets 136. Alternatively, dry additive 132 may be deposited into the tank 106 and mixed with water, seawater, or other suitable fluid from one of the inlets 136 to form a cement slurry. If desired, the dry additives 132 may be wetted or otherwise mixed with the water or another fluid prior to entering the tank 106. The cement slurry is circulated within the tank 106 using one of transfer pumps 118 or alternatively, one of the grinding pumps 108. The crossover manifold 120 allows either of the transfer pumps 118 to circulate the cement slurry within either of the tanks 106 or 116. Such a redundancy in the design of the skid 134 allows the batch cement process to continue if one of the transfer pumps 118 has to be removed from service, for example, for maintenance. The densitometer 122 can be used to monitor the density, flow rate, and other properties of the cement slurry in either tank 106 or 116. The dry additives 132 and water, seawater, or other suitable fluid are added to the tank until the cement slurry properties meet a cement slurry specification. Other additives may be added to the cement slurry using an additive metering system. The cement slurry may then be injected directly into the well bore via one of the discharges 138, or may be transferred to the tank 116 via the crossover manifold prior to being injected into the well bore. Several drains 140 are provided so that the piping of the skid 134 may be emptied, for example, when the skid 134 needs be serviced or cleaned. Of course, persons of ordinary skill in the art will appreciate that the batch cement process implemented in tank 106 as described herein may also be implemented in tank 116. The skid 134 can be configured to prepare the batch of cement in one of the tanks 106 or 116 while the other of the tanks 106 or 116 is used to store another batch of cement being injected into the well bore. Although a batch operation, such alternate operation of the tanks 106 and 116 allows the two tanks 106 and 116 to simulate a continuous operation that prepares and injects the cement slurry as described above.

In an alternative embodiment, the skid 134 shown in FIG. 2 may be modified to remove the tank 106. As a result, the CRI portion of the ICCRS 100 is implemented by feeding the coarse effluent stream from the particle classifier 114 directly into the grinding pumps 108. In the alternative embodiment, the CRI process is implemented by feeding the cuttings 104 and the water or other suitable fluid 102 individually or combined in the form of a cuttings slurry into either the grinding pumps 108 or the particle classifier 114. The CRI process then proceeds as described above. When an alternative embodiment is employed having a single tank and the batch cement process is implemented, the alternative embodiment of skid 134 can only prepare one cement slurry at a time using tank 116. In other words, tank 116 must be emptied before another cement slurry can be prepared in tank 116.

In another alternative embodiment, the skid 134 can be configured to use the fine cuttings as aggregate in the cement slurry. In such an embodiment, the cuttings slurry is processed in the tank 106, the grinding pumps 108, and the particle classifier 114 as described in the above CRI process. However, the fine effluent stream from the particle classifier 114 is fed into the tank 116 where a cement slurry is being prepared according to the aforementioned batch cement process. In other words, the cuttings processing and the batch cement preparation occur simultaneously. Consequently, the fine cuttings and water or other suitable fluid become part of the cement slurry, which is injected into the well bore.

The ICCRS utilizes several components, each of which will now be described in further detail. The raw materials used by the ICCRS include cuttings, water or other suitable fluid, and dry additives. The cuttings are pieces of dirt and rock that are cut away from the bottom of the well bore using the drill bit. As used herein, coarse cuttings are those cuttings that exceed a predetermined size suitable for injection into the well bore. By contrast, fine cuttings are cuttings that are smaller than the predetermined size and are suitable for injection into the well bore. The cuttings are removed from the bottom of the well bore by the drilling fluid and are typically separated from the drilling fluid using a shale shaker or other separation device prior to being utilized by the ICCRS. The water may be fresh water or salt water or other suitable aqueous fluid and may be derived from an underground source, such as a well, or from a surface source, such as a tank or, more commonly, the sea. Other suitable fluids may be employed in addition to or in lieu of water throughout this disclosure. The dry additives are the dry parts used to make cement and optionally include a plurality of aggregate pieces which, in an embodiment, may be the cuttings. The dry additives may also include other chemicals or additives, such as the chemicals added by a chemical or additive metering system.

The tanks allow the ICCRS to mix and store the various raw materials and slurries described herein. The tanks are generally constructed from metal plate, but may be made form any other material, including composite materials. The tanks typically include at least one mixer or agitator that mixes or agitates the components and/or slurries within the tank. The tanks are typically open top tanks with no temperature regulation such that the tank pressure and temperature are the same as the atmospheric pressure and temperature. However, it is contemplated that the tanks may be enclosed such that the tanks maintain a pressure or vacuum and/or are configured with heating or cooling devices to regulate the temperature within the tanks.

The grinding pumps grind the cuttings into fine cuttings and pump the fine cuttings up to the particle classifier and/or the tank. The grinding pumps are generally centrifugal type pumps that contain a plurality of impeller blades configured to reduce the size of some or all of the cuttings passing through the grinding pump. The grinding pump may be equipped with a restrictor plate on the discharge of the pump to alter the residence time of the slurry in the pump. For example, a restrictor plate having smaller holes will result in increased residence time in the grinding pump, which increases the degree of size reduction which occurs in one pass through the pump. Alternatively, the grinding pumps may be another type of pump, such as a positive displacement pump. The grinding pumps are typically connected to an electric or combustion motor that powers the grinding pump. Several grinding pumps suitable for the purposes described herein are available from the Barnes Pump Company of Mansfield, Ohio or a MUD HOG centrifugal pump available from available form Baker Hughes.

The particle classifier separates the coarse cuttings from the fine cuttings and the water or other suitable fluid. While many different embodiments of the particle classifier are within the scope of the ICCRS, in one embodiment the particle classifier comprises a tray containing a plurality of holes of a predetermined size. The cuttings slurry enters the particle classifier and passes over the tray such that the coarse cuttings, which are larger than the holes, pass over the top of the tray and the water or other suitable fluid and the fine cuttings, which are smaller than the holes, pass though the tray. In such a configuration, the particle classifier produces a coarse effluent stream comprising coarse cuttings and a fine effluent stream comprising the remainder of the cuttings slurry, namely the fine cuttings and water or other suitable fluid. If desired, water or other suitable fluid can be added to the stream containing the coarse cuttings to aid in the transportation of the coarse effluent stream. The particle classifier can be configured to transport the fine effluent stream to one of the tanks and transport the coarse cuttings to the other tank. Alternatively, the particle classifier can separate the coarse cuttings, the fine cuttings, and the water or other suitable fluid into three different streams and transport the coarse cuttings and the water or other suitable fluid to one tank and the fine cuttings to a second tank.

The flow divider separates a feed stream into two separate effluent streams With substantially identical compositions. In one embodiment, the flow divider is a pipe tee (T) or wye (Y) that converts one feed stream into two effluent streams. The two effluent streams may be configured with valves that regulate the flow through each of the two effluent streams. In an alternative embodiment, the flow divider may be configured with flow meters, control valves, or other devices to precisely monitor and/or regulate the flow through the two effluent streams.

The transfer pumps transfer the cuttings slurry and/or the cement slurry to other areas of the skid and circulate the cuttings slurry and/or the cement slurry within the tanks. In an embodiment, the transfer pumps are centrifugal pumps that can be configured to circulate the cuttings slurry and/or cement slurry within one or more tanks and/or transport the cuttings slurry and/or cement slurry to another part of the skid or out of one of the discharges. The transfer pumps may also be positive displacement pumps or any other type of pump. Alternatively, the transfer pump may be identical to the grinding pumps described above. Like the grinding pumps, the transfer pumps are typically connected to an electrical motor, hydraulic motor or combustion engine that drives the internal components of the pump. Suitable transfer pumps are available form Halliburton Energy Services.

The densitometer measures the density, flow rate, and other properties of the cuttings slurry and/or cement slurry described herein. The densitometer measures the density of the cuttings slurry and/or cement slurry to ensure that the cuttings slurry and/or cement slurry meet a cuttings slurry specification and/or a cement slurry specification. In other words, the densitometer measures the density of the cuttings slurry and/or the cement slurry to ensure that the cuttings slurry and/or cement slurry will be the proper density when the cuttings slurry and/or cement slurry is injected into the well bore. If desired, the densitometer may also be configured to measure other cuttings slurry properties and/or cement slurry properties, such as the flow rate of the slurry passing through the densitometer. A suitable densitometer is the micro motion line available from Emerson Process Management of Houston, Tex.

The injection pump injects the cuttings slurry and/or cement slurry into the well bore. In one embodiment, the injection pump is a positive displacement pump capable of injecting the cuttings slurry and/or cement slurry described herein into a well bore. In alternative embodiments, the injection pump may be another type of pump, such as a centrifugal pump. Like the transfer pumps, the injection pump is typically connected to an electrical motor or combustion engine that drives the internal components of the pump. A suitable injection pump is the HT400 pump available from the Halliburton Corporation of Houston, Tex.

The ICCRS is also configured with various valves, pipes, and controls to facilitate transportation and control of the components and slurries as shown in the Figures and described herein. In one embodiment, some or all of the valves depicted in FIG. 2 are connected to actuators, which are in turn connected to a central panel or mechanism that coordinates and implements the CRI process and batch cement process described above. For example, the various valves may be computer process controlled. Alternatively, some or all of the valves illustrated in FIG. 2 may be hand valves that are opened and closed by an operator. Moreover, the ICCRS may include piping, valves, and controls other than those illustrated herein. Persons of ordinary skill in the art are aware of how to configure the skid with the necessary piping, valves, and controls such that the skid properly implements the CRI process and the batch cement process described herein.

Figure 3A:
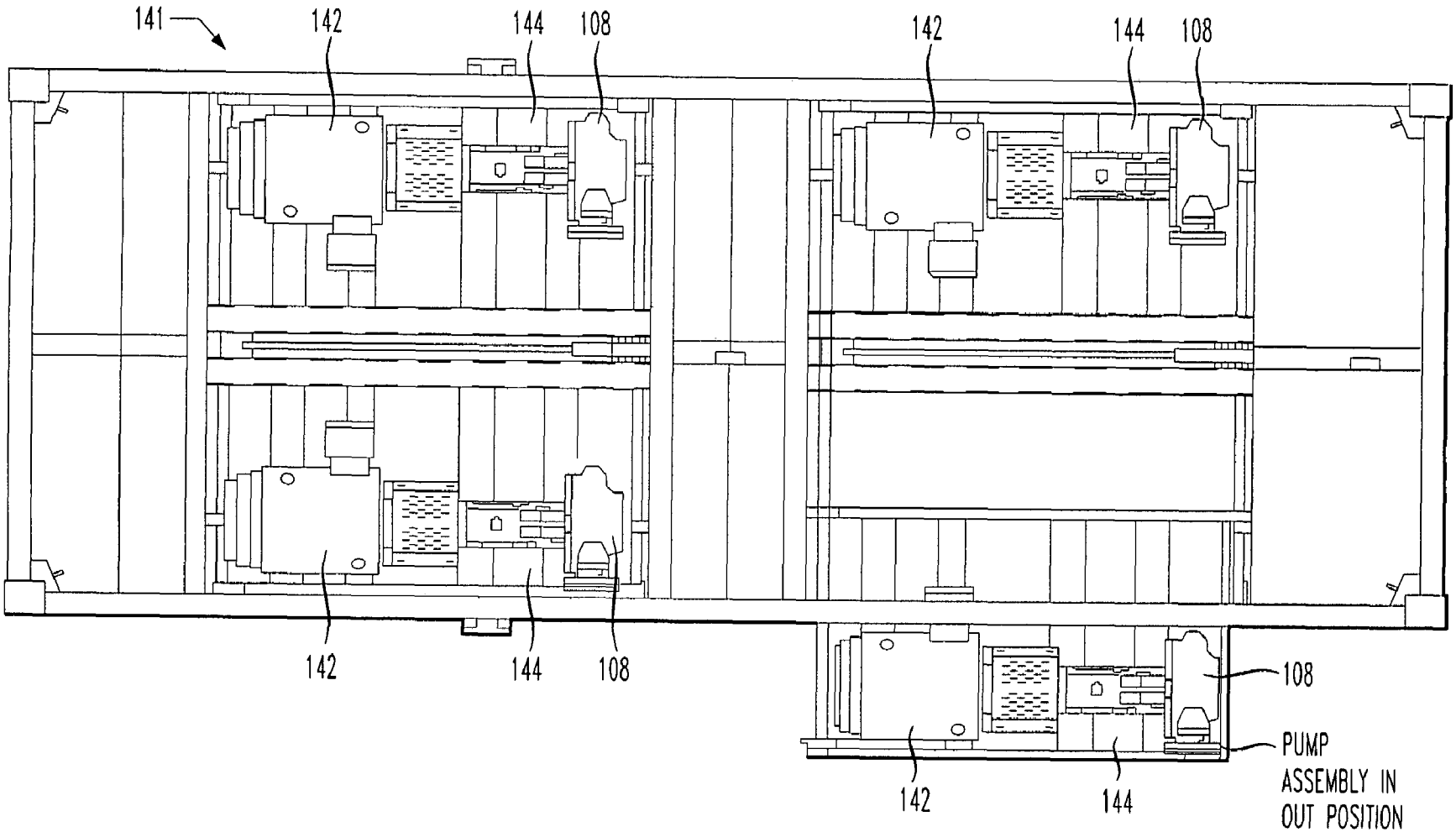
FIGS. 3A, 3B, and 3C are plan, side elevation, and front elevation views, respectively, of one embodiment of a grinding pump sub-skid.
Figure 3B:
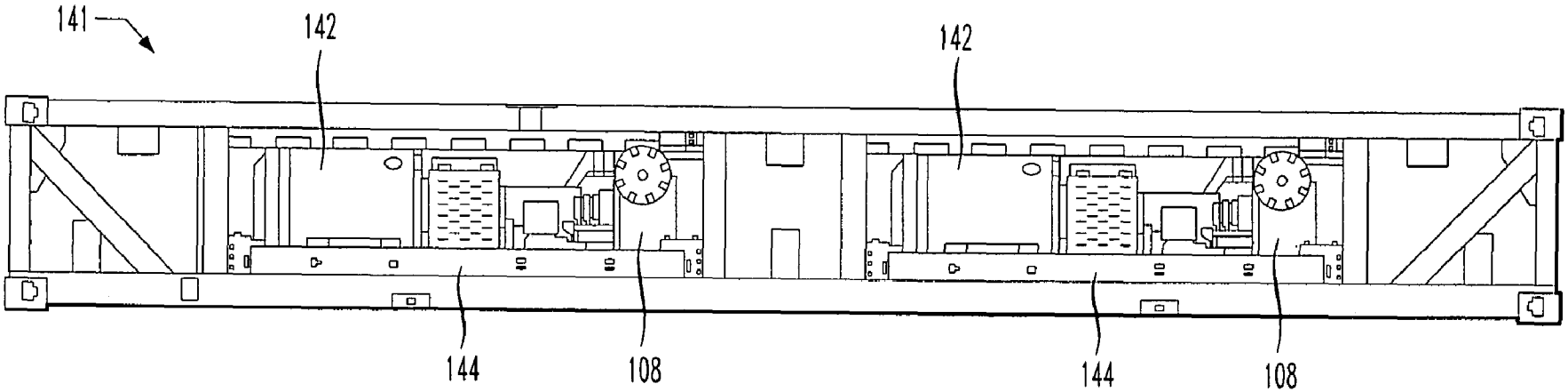
Figure 3C:
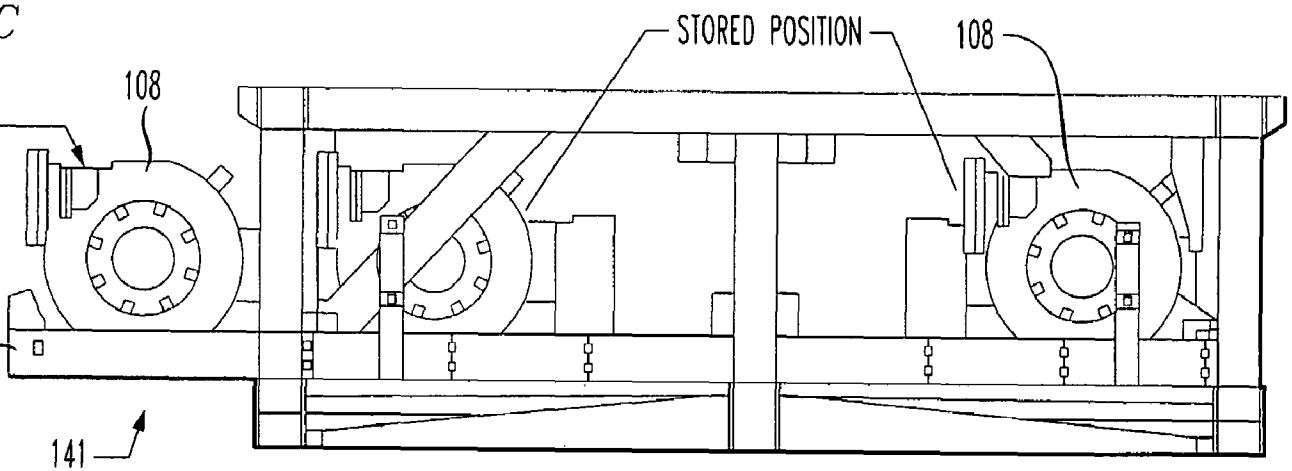

FIGS. 3A, 3B, and 3C are plan, side elevation, and front elevation views, respectively, of the sub-skid 141 used to retrofit the batch cement skid to create the ICCRS. As can be seen in FIGS. 3A, 3B, and 3C, the sub-skid 141 contains four grinding pumps 108 that are each connected to a motor 142 that drives the grinding pumps 108. Each of the four motor 142 and grinding pump 108 combinations is positioned on a tray 144 that slides out from the sub-skid 141 for easy access to the components therein. The motors 142 and grinding pumps 108 are configured with quick connect/disconnect connections for the grinding pumps 108 and flexible power cables for the motors 142 such that the motors 142 and grinding pumps 108 may be easily and quickly pulled out from the sub-skid 141. Once the motors 142 and grinding pumps 108 are pulled out from the sub-skid 141, they may be serviced or replaced and repositioned back into the sub-skid 141 by sliding the tray 144 back into the sub-skid 141. The grinding pump 108 may then be reconnected to the remainder of the skid 134 or sub-skid 141 using the quick connect/disconnect connections.

Figure 4A:
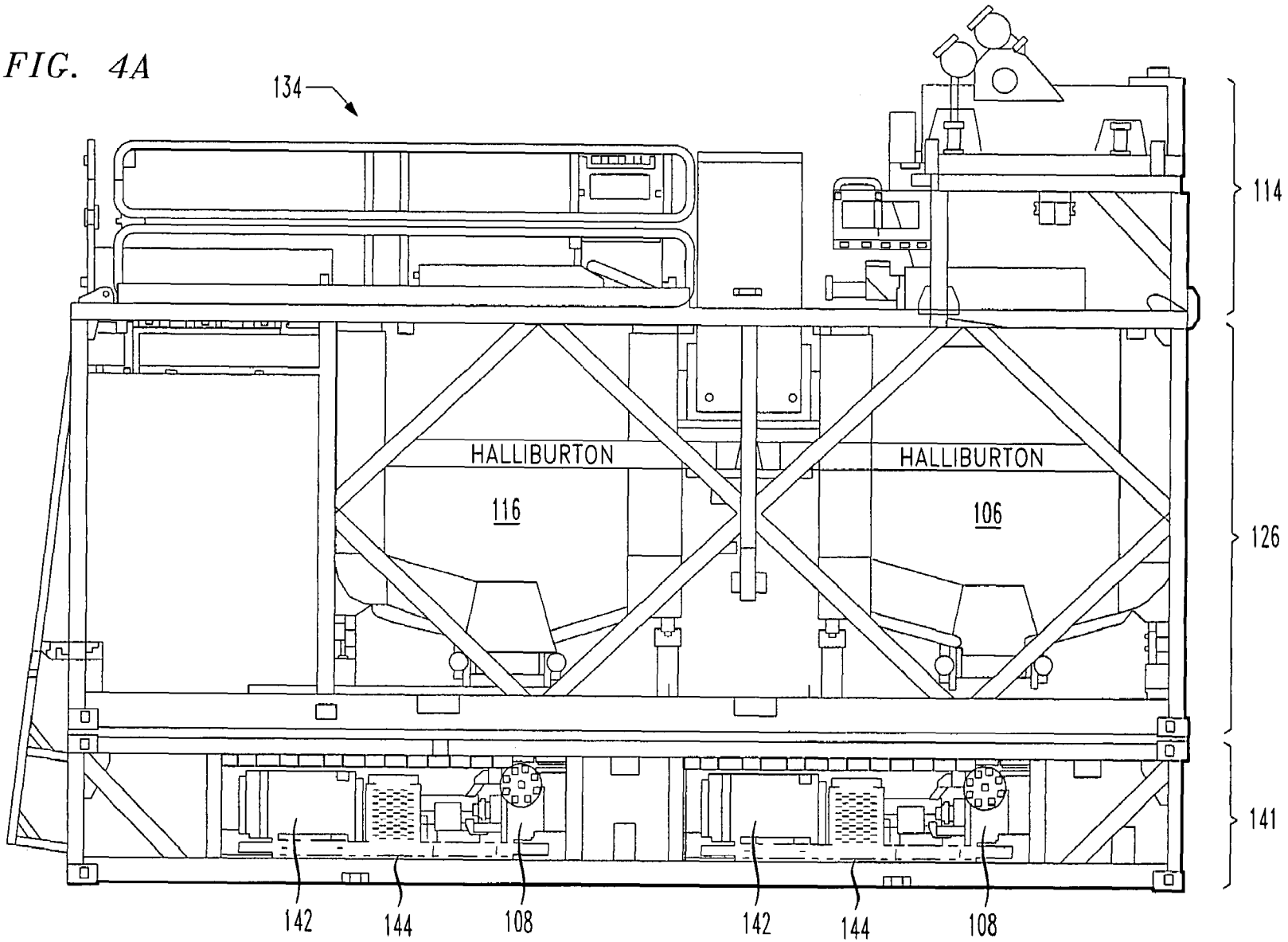
FIGS. 4A and 4B are side elevation and front elevation views, respectively, of one embodiment of a skid for implementing the ICCRS.
Figure 4B:
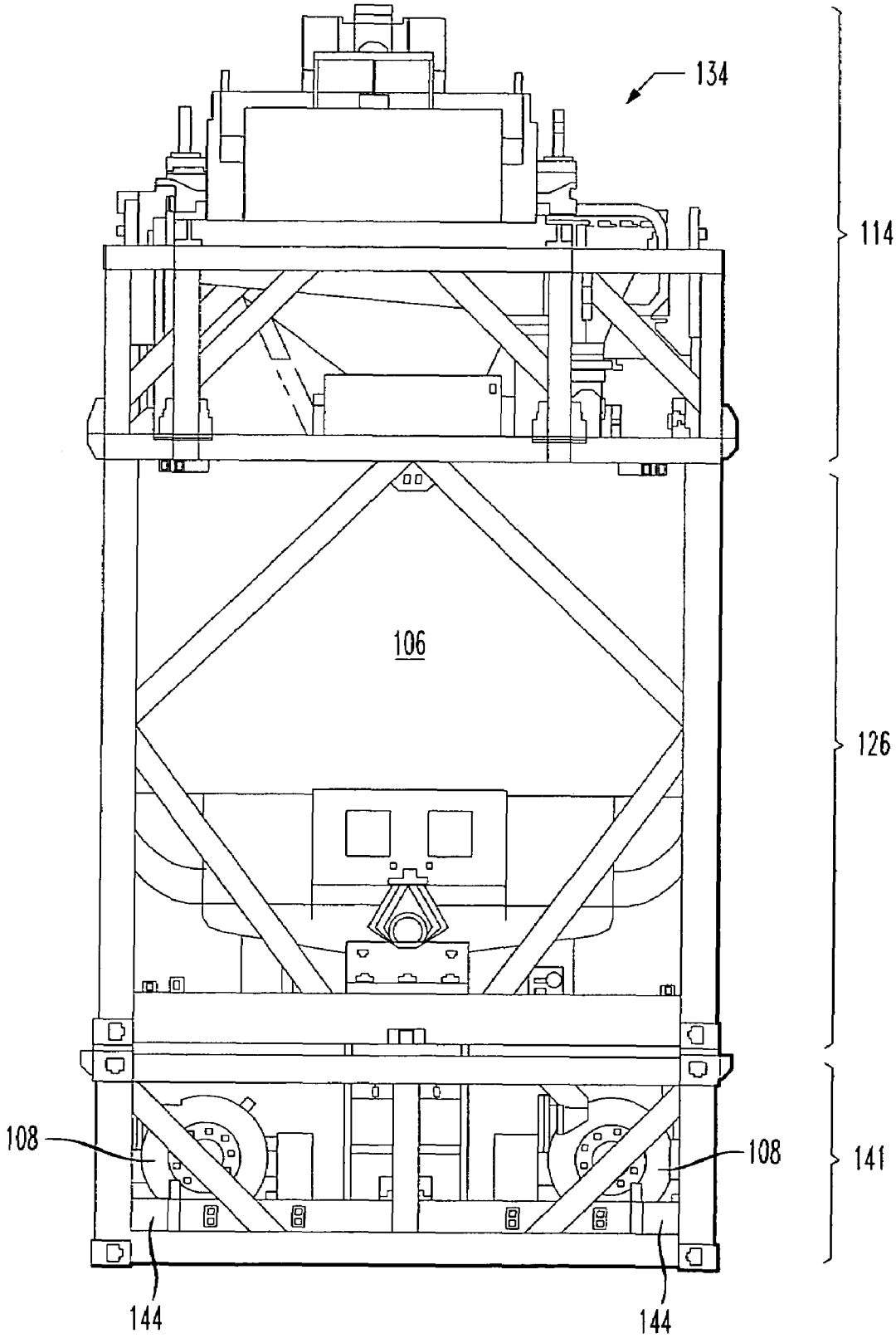

FIGS. 4A and 4B are side elevation and front elevation views, respectively, of one embodiment of a skid 134 for implementing the ICCRS. More specifically, the skid 134 comprises a conventional batch cement skid 126 retrofitted with the particle classifier 114, which has been added onto the top of the batch cement skid 126 , and the grinding pump sub-skid 141 shown in FIGS. 3A, 3B, and 3C, which is added to the bottom of the batch cement skid 126. The particle classifier 114 is located at the top of the skid 134 and separates the cuttings into a fine effluent stream that feeds into tank 116 and a coarse effluent stream that feeds into the tank 106. No pumps are necessary to transport the coarse effluent stream and the fine effluent stream because the coarse effluent stream and the fine effluent stream are gravity fed into the tanks 106 and 116. The grinding pumps 108 are located under the two tanks 106 and 116 and are connected to the tank 106 and the particle classifier 114 such that the grinding pumps 108 grind the drill cuttings in the tank 106 and transport the ground cuttings to the particle classifier 114. No pumps are necessary to transport the cuttings slurry to the grinding pumps 108 because the tank 106 gravity feeds into the grinding pumps 108. Persons of ordinary skill in the art will appreciate that the cuttings may enter the skid 134 at either the tank 106 or the particle classifier 114 and will be processed in a similar manner regardless of the point of entry.

Figure 5:
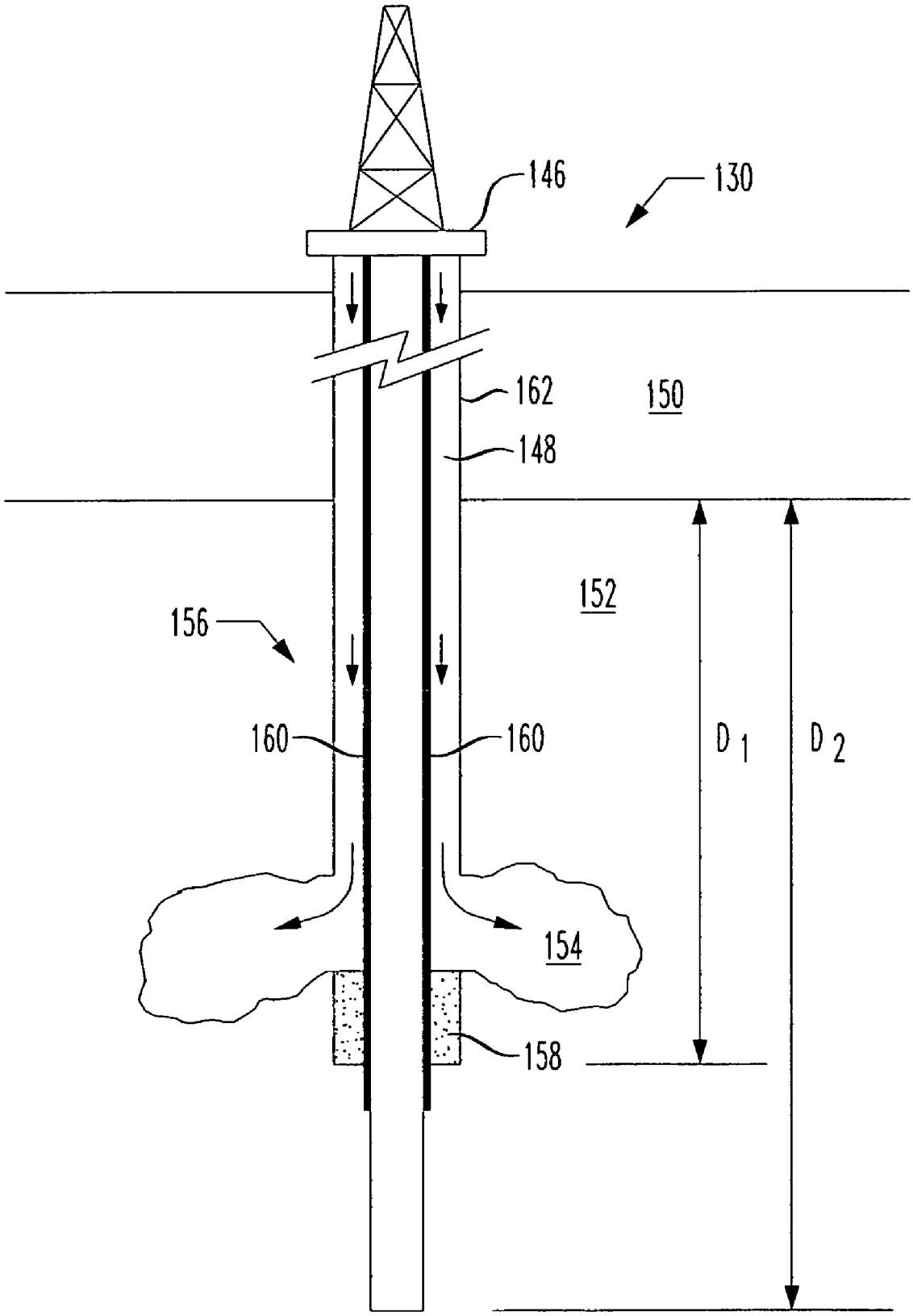
FIG. 5 is a side view of the one embodiment of a drilling platform for implementing the ICCRS.

FIG. 5 is side view of an embodiment of an offshore well 130 used to implement the ICCRS. The well 130 comprises a platform 146, a well bore 156, an annular channel 148, an inner casing 160, an outer casing 162, and a cement sheath 158. As can be seen in FIG. 5, the outer casing 162 is positioned between the platform 146 and the formation 152, thereby separating the inside of the outer casing 162 from the water 150. The well bore 156 is then drilled at to a certain depth $D_1$ and the inner casing 160, which has a diameter smaller than the well bore 156 and the outer casing 162, is installed inside the well bore 156 and secured in place using the cement 158. The outer casing 162, the cement 158, and the inner casing 160 create the annular channel 148 between the platform 146 and a void space 154 within the formation 158. The ICCRS injects the cuttings slurry containing the fine cuttings into the void space 154 via the annual channel 148 as indicated by the arrows shown in FIG. 5. If desired, the space inside the inner casing 160 may be used to simultaneously or subsequently drill the well bore 156 to a deeper depth $D_2$ using a smaller diameter drill string than was used to drill the initial $D_1$ depth of the well bore 156. In an alternative embodiment not illustrated in FIG. 5, a pair of packers can be used to isolate a non-producing zone within a conventional well bore. Once the non-producing zone is isolated, the cuttings slurry can be injected into the formation in a manner similar to fracturing the formation. In yet an alternative embodiment not illustrated in FIG. 5, a separate disposal well may be drilled to dispose of the cuttings. Persons of ordinary skill in the art are aware of methods for drilling a disposal well.

There are several advantages to utilizing the ICCRS to integrate the CRI process and the batch cement process into a single skid. One advantage is that the single skid requires less personnel and resources to operate than two separate skids that separately operate the CRI process and the batch cement process. The reduced utilization of personnel and resources reduces the operating costs of the skid, and hence the operating costs of the drilling process. Another advantage of the integrated skid is that it reduces the floor space utilized on the drilling platform. Reducing the required floor space or footprint of the skid reduces the capital cost of the drilling platform and/or allows additional pieces of equipment to be located on the drilling platform. Yet another advantage of the integrated skid is that it allows for real time measurement of the density of the cuttings slurry. Measuring the density of the cuttings slurry allows the skid to determine when the cuttings slurry is ready to be injected into the well bore. An additional advantage of the integrated skid is that it provides grinding pump redundancy as well as ease of access to the grinding pumps for service. The redundancy is important in that it allows the CRI process or batch cement process to continue when one or more of the grinding pumps are not operational, such as when the grinding pumps are down for maintenance. The trays 144 allow the grinding pumps to be easily accessible such that the grinding pumps can be promptly repaired or maintained and returned to service.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method for integrating a batch cement process wit a cuttings reinjection process, the method comprising: equipping a batch cement skid with a particle classifier and a grinding pump, such that the batch cement skid sequentially implements the cuttings reinjection process and the batch cement process.

2. The method of claim 1 wherein the cuttings reinjection process comprises:

mixing a plurality of coarse cuttings with water or other suitable fluid in a tank, thereby creating a cuttings slurry;

grinding at least some of the coarse cuttings in the cuttings slurry, thereby creating a plurality of fine cuttings; and injecting the fine cuttings into a well bore.

3. The method of claim 2 wherein the cutting reinjection process further comprises: separating the coarse cuttings from the cuttings slurry, such that the cuttings slurry comprises fine cuttings and water or other suitable fluid.

4. The method of claim 3 wherein the batch cement process comprises:

preparing a cement slurry in the tank; and injecting the cement slurry into the well bore.

5. The method of claim 4 further comprising: adding the fine cuttings to the cement slurry prior to injecting the cement slurry into the well bore.

6. The method of claim 4 wherein the batch cement process further comprises:

emptying the cuttings slurry from the tank prior to preparing the cement slurry.

7. The method of claim 6 wherein the particle classifier is positioned above the batch cement skid.

8. The method of claim 7 wherein the grinding pump is located on a sub-skid positioned below the batch cement skid.

9. An apparatus for performing a batch cement process and a cuttings reinjection process, the apparatus comprising:

a first tank comprising a first tank inlet to couple to a shale shaker effluent;

a second tank;

a particle classifier having a coarse effluent stream feeding into the first tank and a fine effluent stream feeding into the second tank; and a grinding pump in fluid communication with the first tank and the particle classifier.

10. The apparatus of claim 9 further comprising: a densitometer in fluid communication with the first tank, the second tank, or the first tank and the second tank.

11. The apparatus of claim 10 wherein the coarse effluent stream is gravity fed into the first tank and the fine effluent stream is gravity fed into the second tank.

12. The apparatus of claim 11 wherein The grinding pump is configured to grind a plurality of cuttings and pump the ground cuttings to the first tank, the particle classifier, or the first tank and the particle classifier.

13. The apparatus of claim 12 wherein The grinding pump is positioned on a tray that slides out from beneath the first tank or the second tank, thereby allowing a user to service the grinding pump.

14. The apparatus of claim 13 wherein the particle classifier comprises a tray comprising a plurality of apertures of the predetermined size, wherein the coarse effluent stream comprises the coarse cuttings and the fine effluent stream comprises a plurality of fine cuttings having a size equal to or smaller than the predetermined size.

15. A drilling platform comprising the apparatus of claim 9.

16. The apparatus of claim 9 wherein the grinding pump comprises a grinding pump effluent and the particle classifier comprises a particle classifier inlet, and wherein the grinding pump effluent is in fluid communication with the particle classifier inlet.

17. A method comprising:

mixing a plurality of coarse cuttings with water or other suitable fluid in a tank, thereby creating a cuttings slurry;

grinding at least some of the coarse cuttings in the cuttings slurry, thereby creating a plurality of fine cuttings;

injecting the fine cuttings into a well bore;

emptying the cuttings slurry from the tank;

preparing a cement slurry in the tank; and injecting the cement slurry into the well bore.

18. The method of claim 17 further comprising: separating the coarse cuttings from the cuttings slurry, such that the cuttings slurry comprises fine cuttings and water or other suitable fluid.

19. The method of claim 18 further comprising: adding the fine cuttings to the cement slurry such that the fine cuttings and the cement slurry are injected into the well bore together.

20. The method of claim 19 further comprising:

measuring a density of the cuttings slurry;

comparing the density of the cuttings slurry to a density specification;

responsive to the determination that the density of the cuttings slurry is less than the density specification, adding additional fine cuttings or a dry additive to the cuttings slurry; and responsive to the determination that the density of the cuttings slurry is greater than the density specification, adding additional water or other suitable fluid to the cuttings slurry.

* * * * *